US010003129B2

(12) United States Patent
Wang et al.

(10) Patent No.: US 10,003,129 B2
(45) Date of Patent: Jun. 19, 2018

(54) HIERARCHICALLY ELABORATED PHASED-ARRAY ANTENNA MODULES AND METHOD OF CALIBRATION

(71) Applicants: James June-Ming Wang, Pasadena, CA (US); Chak-Ming Chie, Culver City, CA (US); Hamed Alsuraisry, Riyadh (SA); Saleh Alsaif, Riyahd (SA); Abdulelah Alshehri, Riyahd (SA)

(72) Inventors: James June-Ming Wang, Pasadena, CA (US); Chak-Ming Chie, Culver City, CA (US); Hamed Alsuraisry, Riyadh (SA); Saleh Alsaif, Riyahd (SA); Abdulelah Alshehri, Riyahd (SA)

(73) Assignees: Tubis Technology Inc, Pasadena, CA (US); King Abdulaziz City for Science and Technology, Riyadh (SA)

( * ) Notice: Subject to any disclaimer, the term of this patent is extended or adjusted under 35 U.S.C. 154(b) by 254 days.

(21) Appl. No.: 14/983,293

(22) Filed: Dec. 29, 2015

(65) Prior Publication Data

US 2017/0187108 A1 Jun. 29, 2017

(51) Int. Cl.

| | |
|---|---|
| ***H01Q 3/00*** | (2006.01) |
| ***H01Q 3/26*** | (2006.01) |
| ***H01Q 3/02*** | (2006.01) |

(52) U.S. Cl.

CPC ..... *H01Q 3/267* (2013.01); *H01Q 3/02* (2013.01)

(58) Field of Classification Search

CPC ..... H01Q 3/00; H01Q 3/267; H01Q 3/02
USPC ..... 342/359
See application file for complete search history.

(56) References Cited

U.S. PATENT DOCUMENTS

| | | | | |
|---|---|---|---|---|
| 2003/0151549 | A1* | 8/2003 | Solbach | H01Q 3/26 342/368 |
| 2007/0206686 | A1* | 9/2007 | Vook | H04B 7/0671 375/260 |
| 2016/0043465 | A1* | 2/2016 | McDevitt | H01Q 3/267 342/368 |
| 2016/0156100 | A1* | 6/2016 | Sikina | H01Q 3/267 342/352 |

* cited by examiner

*Primary Examiner* — Harry K Liu
(74) *Attorney, Agent, or Firm* — Patentry; Peter G. H. Hwang

(57) ABSTRACT

An apparatus consisting of hierarchically elaborated antenna modules is calibrated by steps. Although the AWV can be calculated mathematically based on the required phase shift values of each antenna element for a beam direction to compensate for signal delay. However, in practice, due to hardware implementation imperfection, coupling in signal path for each antenna element within hardware, inaccuracies of implementations, physical misalignment, the mathematically generated AWV does not necessarily provide alignment between transmit beam and receive beam. This subset is sufficient is all practical operation. The subset of AWVs are typically called codebook and the receiver beam points to different direction by using a AWV within the codebook.

8 Claims, 3 Drawing Sheets

HIERARCHICALLY ELABORATED PHASED-ARRAY ANTENNA MODULES AND METHOD OF CALIBRATION

CROSS-REFERENCES TO RELATED APPLICATIONS

None

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISK OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

Technical Field

A steerable beam antenna system using a phased-array of planar elements operating on several dissimilar frequencies or wavelengths.

Description of the Related Art

In a phased-array module with transmit and receive capabilities, it is desirable to have transmit beam aligned with receiver beam precisely. When the array antenna size is bigger, the beamwidth of the antenna beam is smaller and the required precision of alignment increases.

In a typical user terminal designed for mobility, the phased array antenna scans its field of view to find the incoming signal from the transmitter of a remote terminal or hub. When the receive antenna beam points to the correct direction, the incoming signal is received with high signal strength and demodulated. From the demodulated and decoded signal, the receiver acquires the proper status of the system operation and obtains some time window for its transmission. If the transmit antenna beam is aligned with the receive antenna beam, the signal transmission by the user terminal at the allowable time window of transmission can reach the remote terminal at proper strength (i.e., transmit signal toward the remote terminal enhanced with the high antenna gain) to allow the receiver of the remote terminal to process immediately.

If the transmit beam is poorly aligned with the receive beam in the phased-array antenna of the user terminal, a transmit beam training operation is performed in which the transmitter scans its signal across the region of the remote terminal to allow the remote terminal to acquire the signal at a local maximum. The remote terminal needs to feedback the status once it acquires the signal. Obviously, this operation is significantly more complex than the case in which a transmit beam is aligned with the receive beam.

When the phased-array antenna is being calibrated (the operation of aligning the transmit beam to the receive beam), the transmit AWV (antenna weight vector) is changed until the transmit beam precisely points to the same direction as the receive beam. This is usually performed within an anechroic chamber with a test antenna (which contains TX and RX) and the array antenna to be calibrated positioned within opposite sides of the chamber. The test antenna first transmits a signal to allow the phased-array antenna receive beam to adjust until peak power is received (meaning the receiver beam of the phased-array antenna is pointing at the test antenna direction). The phased-array antenna then transmits using different antenna beams (AWVs) until the test antenna received power is peaking. Note that in theory the AWV can be calculated mathematically based on the required phase shift values of each antenna element for a beam direction to compensate for different signal delays at antenna elements. However, in practice, due to hardware implementation imperfection, coupling in signal path for each antenna element within hardware, inaccuracies of implementations, physical misalignment, the mathematically generated AWV does not necessarily provide accurate alignment between transmit beam and receive beam.

There are a large number of AWVs (beams) in a large phased-array antenna. Phased-array antenna with n antenna elements consisting of n phase shifters. If the phase shifter has 2^k steps (a k-bit phase shifter), the number of possible AWVs would be 2^(k*n). A brute-force calibration going through 2^(k*n) AWVs can take extremely long time. Hence there is a need to uses a novel procedure to simplify the number of calibration states.

In principle, only a subset of receive antenna beam are needed. For example, if the beamwidth of an antenna of interest is 2 degree, the subset of antenna beams and its corresponding AWVs which are separated by 1 degree in pointing angle would be sufficient. The subset would cover the FoV with 1 degree beam step. This subset with 1 degree granularity is sufficient in practical operation. Small granularity can require a larger set of beams. The subset of AWVs is called codebook and the receiver beam points to each different direction by using an AWV within the codebook. The calibration of transmit beam is performed over each of the receive beam within the codebook.

A conventional phased-array antenna enables a highly directive antenna beam to be steered toward a single certain direction. The direction of an antenna beam may be controlled by setting the phase shifts of each of the antenna elements in the array. However, to enable higher mobility, the phase shifts must be updated more quickly than conventionally practiced. In addition, cost and space considerations eliminate the obvious deployment of parallel data buses. For sensitive RF circuits and interconnection in an phased-array antenna, it is also necessary to simplify and confine the amount of digital interconnection. Thus it can be appreciated that what is needed is a more efficient way of dissemination of the phase shift control information to a substantial number of phase shifters for an antenna array with a high number of antenna elements and possibly more than one simultaneous target.

Steerable single frequency phased-array antennas are known. Low Temperature Co-fired Ceramic (LTCC) devices are known. LTCC technology is especially beneficial for RF and high-frequency applications. In RF and wireless applications, LTCC technology is also used to produce multilayer hybrid integrated circuits, which can include resistors, inductors, capacitors, and active components in the same package. There are a number of similar low loss RF and high frequency substrates such as Rogers, Teflon, and Megtron 6, which are suitable for multilayer construction.

As is known, a planar antenna using layer substrate or LTCC (low temperature co-fired ceramic) or similar substrate material can be constructed using printed circuit board techniques.

As is known, a planar phased-array antenna consists of a number of antenna elements, deployed on a planar surface. Incoming planar waveforms arrive at different antenna elements of a receive phased-array antenna at different delays. These delays are conventionally compensated with phase shifts before the signals are combined. Conversely, a transmit array consists of a number of antenna elements on a planar surface, and the signals for these elements are phased shifted before they are transmitted to compensate for signal delay toward a certain direction.

$$F(\cos\alpha_{xs}, \cos\alpha_{ys}) = \sum_{m=0}^{M-1}\sum_{n=0}^{N-1} |A_{mn}| e^{j\left[m\frac{2\pi}{\lambda}dx(\cos\alpha_x - \cos\alpha_{xs}) + n\frac{2\pi}{\lambda}dy(\cos\alpha_y - \cos\alpha_{ys})\right]}$$

It is desirable to have a smooth element pattern which covers the array field of view (FoV).

For a planar phased-array antenna with antenna elements deployed with regular spacing in a grid, the spacing between adjacent elements must be less than a certain value, determined by its scanning angle, to prevent grating lobe.

Furthermore, the dimension of the antennas on a substrate may be optimized by the thickness of the substrate which would be desirably proportional to the wavelength or the inverse of the operating frequency.

Suppose a first antenna is designed to operate at a certain frequency. In order to preserve the same antenna properties (matching, bandwidth, gain, . . . ) at a second antenna for a second frequency, all relative dimensions of the second antenna design must be approximately inversely proportional to its second frequency.

Based on the above discussion, if a planar antenna is designed on a substrate, the thickness of the substrate should be approximately proportional to the inverse of operating frequency.

However, to generate a smooth antenna pattern with a wide beamwidth, it is necessary to have large enough ground plane—typically, ground plane size $>\lambda\times\lambda$ Note that it is difficult, especially for antenna 2, to have sufficient size ground plane due to limited available aperture.

It is also difficult to obtain good isolation since the two antenna elements are separated by sub-wavelength distance.

What is needed is a method to reduce the number of calibration states for a large number of AWVs (beams) in a large phased-array antenna. A phased-array antenna with n antenna elements consists of n phase shifters. If the phase shifter has 2^k steps (a k-bit phase shifter), the number of possible AWVs would be 2^(k*n). A brute-force calibration going through 2^(k*n) AWVs can take extremely long time.

BRIEF SUMMARY OF THE INVENTION

A transmit beam is calibrated from strengths of a plurality of beams recorded from a test horn.

A loss/gain through the phase shifter is equalized with a variable gain amplifier for each phase shifter state. Thus, all phase shifter+variable gain amplifier states has the same loss/gain value.

Step 1: Break up the antenna into L receive subarrays, and the corresponding L transmit subarrays. Preferably, L receiver sub-arrays are of substantially equal size and the corresponding L transmit subarray are of equal size. The number of phase shifters in a subarray is sufficiently small to facilitate calibration.

Step 2: Note that in the test setup for determining the receive codebook, the antenna under test is placed on a precision mechanically rotatable platform for adjustment of antenna orientation. In the test setup for determining the receive codebook, the mechanical platform is adjusted to the given receive beam direction and the receive beam is pointed by peaking the array received power from the test horn. From this the AWV of the receive beam direction is selected from a pre-determined procedure and stored in the receive AWV codebook.) Within Step 2, several embodiments can be employed to calibrate the corresponding transmit subarray. Once the receive beam of sub-array is selected, the same procedure is used for the transmit sub-array.

Step 3: A receive beam of the bigger subarray is formed from the combined corresponding transmit sub-array AWV. A quick search among the AWVs from the calibrated transmit subarray in small perturbed direction around the intended direction can be conducted to see if the received signal strength of the test horn can be increased. This way the receive beam of a bigger subarray is calibrated. The same procedure is applied to the corresponding bigger transmit subarray.

Step 4: The process of Step 3 is repeated for incrementally bigger sub-array until the entire array is calibrated.

A method to reduce the calibration steps of a transmit antenna is disclosed in detail.

The method applies to planar phased-array antenna as follows.

One aspect of the invention is a system which includes a processor circuit for control over an antenna element array by generation of an first operand and a first global write command and a second operand and a second global write command; the processor coupled to a serial bus on a system printed circuit board which conductively transmits operands and commands, the serial bus coupled to a plurality of phase-array transformation (PhAT) circuits, whereby the first operand is stored into each of the plurality of PhAT circuits substantially simultaneously and the second operand is stored into each of the plurality of PhAT circuits substantially simultaneously wherein the operands are generated to direct a beam direction.

An efficient phase calibration scheme for a phased-array antenna consisting of a number of small submodules (sub-arrays) is disclosed. Each submodule (subarray) has a digital interface and contains a number of antenna elements and the associated phase shifters. The disclosed phase control scheme requires dissemination of minimum amount of phase control information to the submodules.

A serial bus is used to disseminate the phase shift control information. The serial bus has the advantages of simplicity and reduced volume, routing, and cost over a conventional parallel bus. This is especially true for a phased-array antenna with high number of antenna elements. Minimizing the distribution of information enables a substantially lower bus speed and cost.

An array of registers local to each antenna element of a phased-array antenna contains phase shifter and gain equalizer values. Receiving an address, position, or location within the register array from a directional beam controller determines a beam direction. These values can be preloaded and a specific set of phase shifter and gain equalizer values corresponding to a beam direction indicated by disseminating a pointer. Alternatively, a digital functional logic circuit for each antenna element can determine the required phase shift on the fly by receiving a phase increment broadcast to every antenna element.

An apparatus is configured to efficiently elaborate phase shift weights into a submodule of a phased-array antenna system. Each subarray phase control submodule is uniquely configured to receive and elaborate weights for a submodule of elements to control phase shifters. Major operators and minor operators are received and transformed by an apparatus coupled to a phased-array antenna suitable for a high mobility device. Each submodule determines its own base phase shift weight per its unique configuration. A recursive adder or multiplier applies phase increments to direct an antenna beam by controlling elements within an array subset.

A phased-array antenna panel is constructed from building blocks. These are a plurality of front end modules, mounted to a Printed Circuit Board (PCB).

Each front end module has a plurality of antenna elements coupled to a frontend die. The frontend die is coupled to a phased-array processing die.

A customized and customizable Radio Frequency Integrated Circuit (RFIC) device includes: phased-array processing blocks; phase-shifters, combiners, splitters, gain equalizers, buffer amplifiers, and a digital signal control and interface circuit.

A register array in each RFIC is grouped into a local register group and a central register group, the local registers physically placed close in proximity to RF chains which each correspond to an element of array antenna, whereby each set of local registers control an individual antenna element and a central register controlling overall RFIC function.

The system provides several choices for configuring the antenna array. A lookup method determines antenna element phase and gain settings from storage or a computation method determines antenna element phase and gain settings. They may be used separately or combined for corner cases.

A conductive wall (typically realized by a plurality of conductive vias with small spacing) coupled to a first ground plane isolates electromagnetic fields of a first antenna patch from electromagnetic fields of a second antenna patch. A second ground plane optimizes the performance of the second antenna patch.

A planar antenna with multiple ground planes is provided to optimize operation at more than one frequency. The ground plane separation below each antenna patch is determined by its operating wavelength.

The first patch elements are isolated by a conductive wall in a multi-layer substrate. The conductive wall effectively sets the size of the ground plane below the first patch, which influences its radiation properties.

Orthogonal polarization of antenna patches further improve signal discrimination. Below the surface layer, another conductive wall isolates each quadrature hybrid technology used to realize orthogonal polarization.

One embodiment of the invention is a method to fabricate a single planar antenna of phased-array elements optimized to operate at more than one frequency out of layers of dielectric substrates.

Metal walls (e.g. approximated with a plurality of metal vias, or metal mesh in the metal layer or stacked layers within a multilayer structure) passing through a dielectric surround a raised ground plane to isolate electrical fields of each frequency.

Quadrature hybrid isolation is provided by a metal wall (e.g. approximated with a plurality of metal vias or mesh). The polarization of the transmit element and the receive element are independent and each can be circular, elliptical and linear.

The present invention includes two separate antenna elements on the same aperture, one for each frequency. The present disclosure enables the placement of two separate antennas in the same aperture while maintaining small separation. The plurality of vias or mesh effectively approximates a metal wall which defines the size of the elevated ground plane. This makes the resultant antenna element pattern smooth. The metal wall shields the fringing fields of one antenna from the other, thus providing very good isolation.

The present invention provides a method to fabricate a single planar antenna of phased-array elements optimized to operate at more than one frequency.

The fabrication of a multi-layer substrate enables ground planes suitable for two different frequencies. The substrate may be ceramic substrate or organic substrate.

BRIEF DESCRIPTION OF THE SEVERAL VIEWS OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DISCLOSURE OF EMBODIMENTS OF THE INVENTION

Figure 1A:
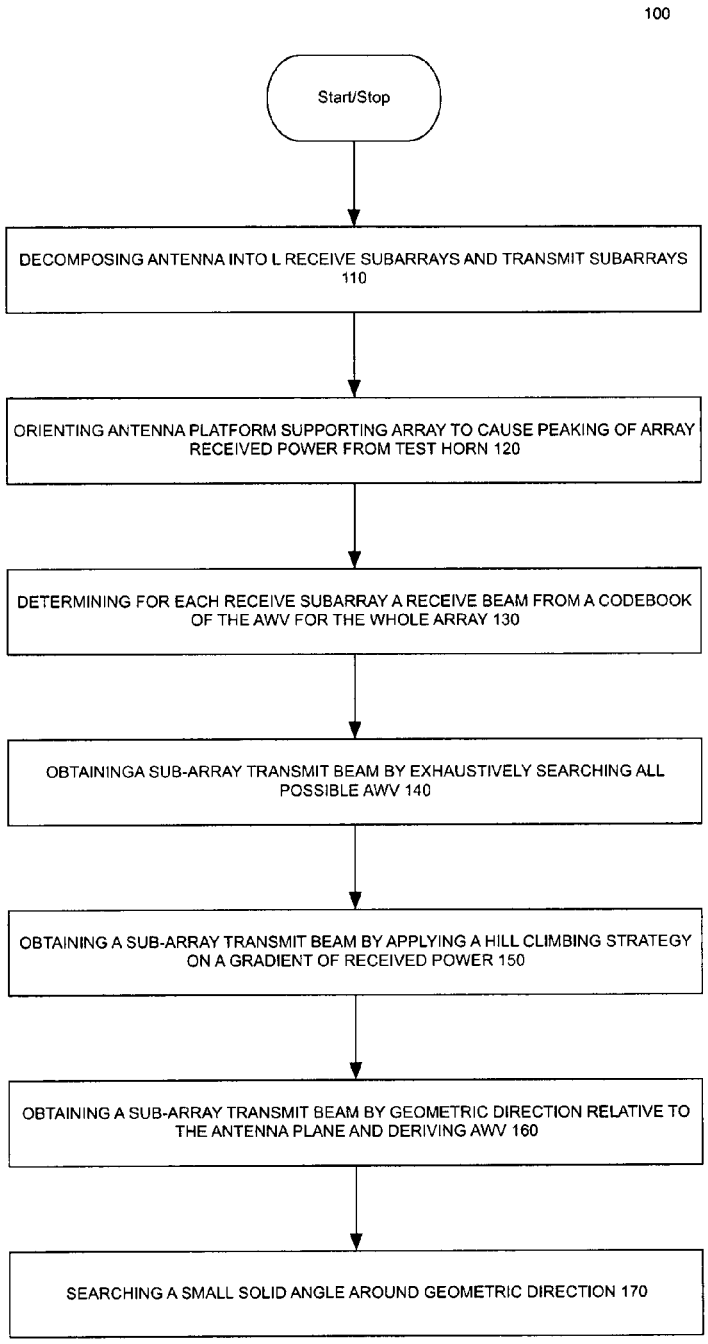
FIG. 1A and 1B are flowcharts of a method of calibration.

A hierarchical method of calibration simplifies fabrication of a large phased-array antenna. Step 1: Break up the antenna into L receive subarrays, and the corresponding L transmit subarrays. Note that the size of the receive subarray in proportional to the whole receive array is roughly equal to the size of the corresponding transmit subarray in proportional to the whole transmit array. Preferably, L receiver sub-arrays are of equal size and the corresponding L transmit subarray are of equal size. The sub-array is of reasonable size (i.e., the number of phase shifters is sufficiently small) to facilitate calibration.

Step 2: Note that in the test setup, the antenna is mounted on a precision mechanically rotatable platform and the orientation of the antenna platform is adjusted such that the physical boresight direction of platform is pointed toward the test horn (peaking the array received power from the test horn).

In one embodiment, the corresponding sub-array receive beam and the transmit beam can be obtained from exhaustively searching through all possible AWVs. The number of all possible receive and transmit sub-array AWVs are of reasonable value.

In another embodiment, a search algorithm can be employed to efficiently search through the possible AWVs based on, for example, gradient of the received power as a function of the AWV (hill climbing algorithm). When a given AWV is employed, the corresponding signal strength is recorded. A perturbed AWV is derived to off-point the beam in a slightly different direction and the corresponding signal strength is compared to the previous value to derive the next perturbed direction.

In another embodiment, the AWV of the subarray can be found via geometric direction relative to the antenna plane of the receive subarray and using mathematically derived AWV for that direction. A small region (in solid angle) around the geometric direction can be searched to account for possible hardware implementation imperfection or tolerances. Alternatively, a subset of perturbed AWV from the mathematically derived AWV is used for finding the highest signal strength.

Note that because the size of sub-array is smaller than whole array and the beamwidth of the subarray is wider than the whole array. If there is any small misalignment of transmit or receive beam relative to the mechanical platform direction or between the transmit and receive beam, it would not significantly affect the final formation of the transmit beam for the whole array.

In step 2, all receive subarray beams are aligned with the mechanical platform directions and all subarray transmit beams are aligned with the subarray receive beams based on the above method. Note that the selected subarray AWVs are recorded in a subarray codebook for each subarray.

Step 3: Following step 2 approach, a bigger subarray can be calibrated. For example, a bigger sub-array can consist of 16 subarrays in step 2 in 4×4 configuration. For each receive beam of the bigger array, the antenna platform orientation is adjusted to peak the array received power from the test horn (i.e., the receive beam direction points toward the test horn). Note that instead of exhaustively searching all possible AWVs for the bigger array, the subarray beams are adjusted using the subarray AWV only from the codebooks recorded in Step 2. The corresponding transmit beam of the bigger subarray is formed from the combined corresponding transmit sub-array AWV. A quick search among the AWVs from the codebook calibrated transmit subarray in small perturbed direction around the intended direction can be conducted to see if the signal strength of the test horn can be increased. This way the transmit beam of the bigger subarray is calibrated.

Step 4: The process of Step 3 is repeated for incrementally bigger sub-array until the entire array is calibrated.

Figure 1B:
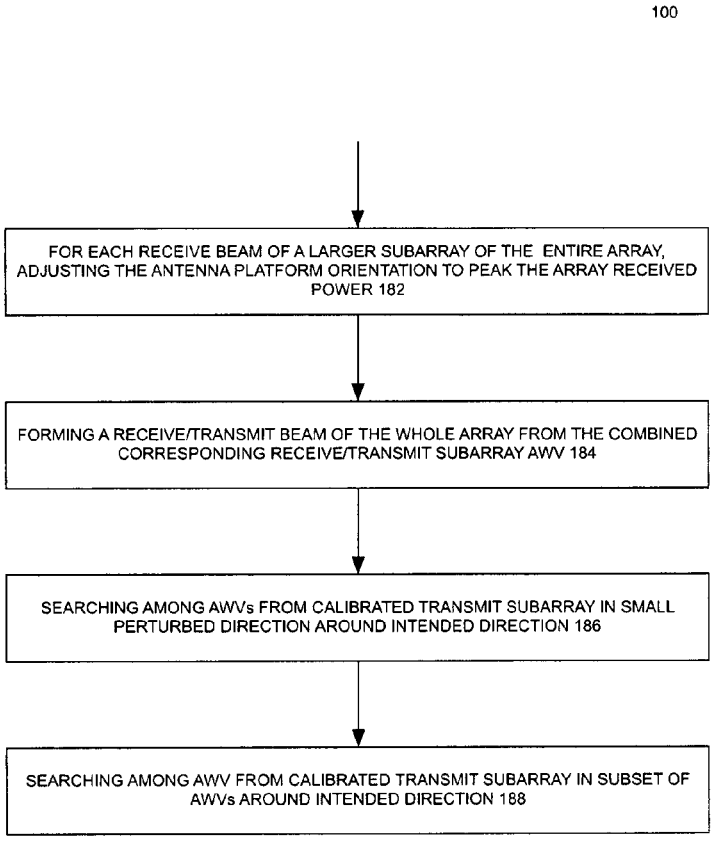

Referring now to the drawings, a method is disclosed in FIGS. 1A and 1B. One aspect of the invention is a process for calibration of antenna weight vectors (AWV) for a large phased-array antenna(antenna), the method including: decomposing an antenna into a plurality (L) of receive subarrays, and an identical plurality of transmit subarrays of equal size; orienting an antenna platform supporting the antenna to cause peaking of the array received power from a test horn; and determining for each receive sub-array of the L receive sub-arrays, a receive beam from the codebook of the receiver antenna weight vector (AWV) for the whole array.

Figure 2:
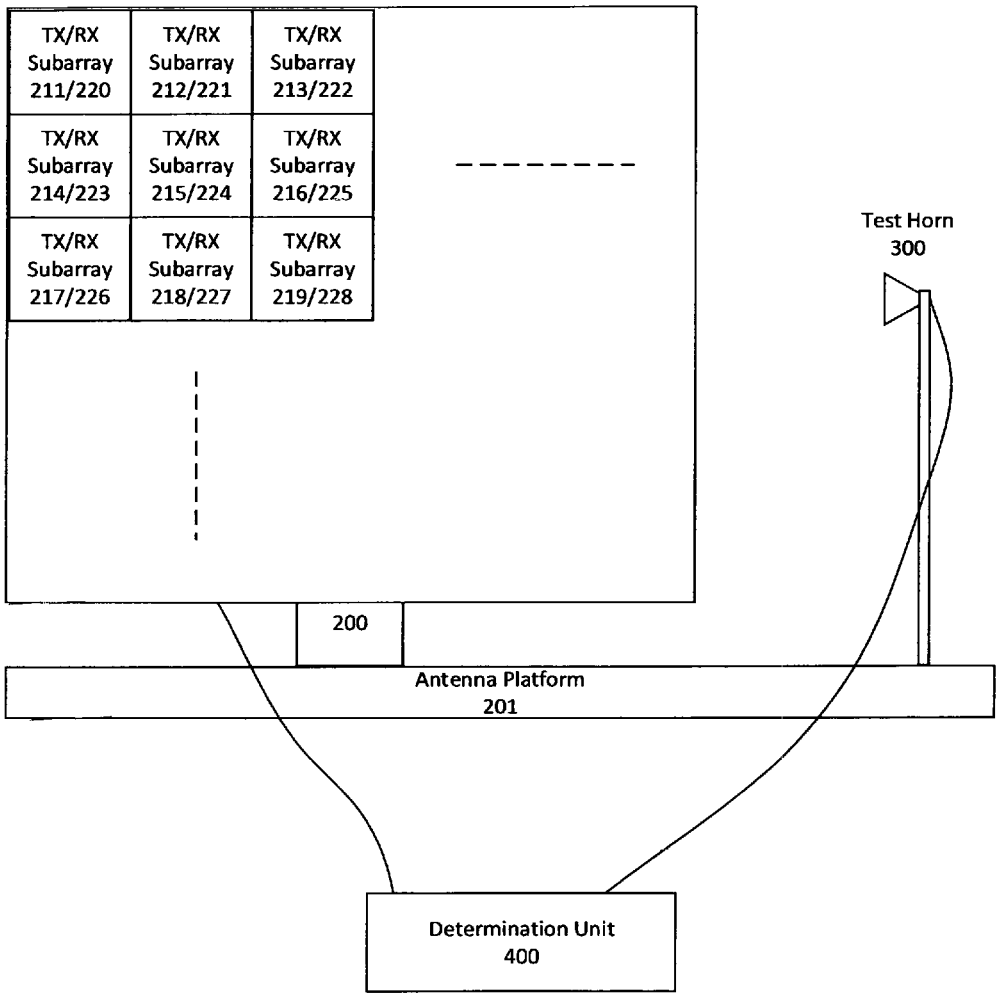
FIG.2 is an illustration of a calibration laboratory suitable for performance of the claimed method.

Referring now to FIG. 2, decomposition of the large phased-array antenna 200 provides a plurality (L) of receive subarrays 211-2L9, and an identical plurality of transmit subarrays 220-2L8 of equal size; orientation of an antenna platform 201 supporting the large phased-array antenna 200 causes peaking of the aggregate received power from a test horn 300; and a determination unit 400 for determination for each receive sub-array of the L receive sub-arrays, a receive beam from the codebook of the receiver antenna weight vector (AWV) for the whole large phased-array.

In an embodiment, the method also includes obtaining a sub-array transmit beam by exhaustively searching through all possible AWVs on the condition that the number of all possible transmit sub-array AWVs are reasonable.

In an embodiment, the method also includes obtaining a sub-array transmit beam by applying a hill climbing strategy on a gradient of the received power as a function of the AWV in an optimized search.

In an embodiment, the method also includes obtaining a sub-array transmit beam by geometric direction relative to the antenna plane of the receive subarray and using mathematically derived AWV for that direction.

In an embodiment, the method also includes searching a small solid angle around the geometric direction to account for possible hardware implementation imperfection or tolerances.

In an embodiment, all subarray transmit beams are aligned with the subarray receive beams.

In an embodiment, the method also includes for each receive beam of a larger subarray of the entire array, adjusting the antenna platform orientation to peak the array received power from the test horn; and forming a receive/transmit beam of the whole array from the combined corresponding receive/transmit sub-array AWV.

In an embodiment, the method also includes searching among the AWVs from the calibrated transmit subarray in small perturbed direction around the intended direction to increase the received signal strength of the test horn.

In an embodiment, the method also includes searching among the AWVs from the calibrated transmit subarray in subset of AWVs around intended direction to increase the received signal strength of the test horn.

One embodiment of the invention is a stack of ceramic or organic dielectric substrates which have conductive film and filled holes.

A planar antenna array has multiple ground planes to optimize operation at more than one frequency.

Phased-array elements are isolated by a conductive wall (that can be approximated by a plurality of conductive vias) in a multi-layer substrate.

One aspect of the invention is an article of manufacture for a multiple band planar phased-array antenna system comprising a plurality of substrate strata: a delta strata includes a substrate of thickness proportional to a difference between a first wavelength of a first signal operating at a first frequency and a second wavelength of a second signal operating at a second frequency; a plurality of conductive walls isolating electromagnetic fields of a first signal from electromagnetic fields of a second frequency; a plurality of signal carrying leads of the first signal; a plurality of signal carrying leads of the second signal; and a film of radio frequency (rf) conductive material applied to an upper most surface of the substrate material orthogonal to the leads and conductive walls, partitioned to a plurality of areas above and coupled to each signal carrying lead and a plurality of areas bounded by each conductive wall with an opening surrounding the film above signal carrying leads of the first signal, wherein the conductive walls and the area bounded by the conductive walls are grounded with respect to the first signal.

In an example the article of manufacture also has a topmost strata including a substrate of thickness proportional to a first wavelength of a first signal operating at a first frequency; a plurality of conductive walls embedded into the substrate isolating electromagnetic fields of a first signal from electromagnetic fields of a second frequency; a plurality of signal carrying leads of the first signal embedded into the substrate; a plurality of signal carrying leads of the second signal embedded into the substrate; and a film of rf conductive material applied to an upper most surface of the substrate material orthogonal to the leads and conductive walls, partitioned to a plurality of antenna patches coupled to each signal carrying lead and a plurality of hollow areas above each conductive wall isolating the electromagnetic fields of the first signal from the electromagnetic fields of the second signal wherein the conductive walls and the hollow area above the conductive walls are grounded with respect to the first signal.

In an example, the article of manufacture also has a base strata which includes substrate material intended to be separated from the antenna patches when assembled by a distance proportional to a second wavelength of a second signal operating at a second frequency; a plurality of conductive walls isolating electromagnetic fields of a first signal from electromagnetic fields of a second frequency; a plurality of signal carrying leads of the first signal; a plurality of signal carrying leads of the second signal; and a film of rf conductive material applied to an upper most surface of the substrate material orthogonal to the leads and conductive walls, partitioned to a plurality of areas above and coupled to each signal carrying lead and an area with perforations surrounding the film above each signal carrying lead, wherein the conductive walls and the perforated area are grounded with respect to the first signal and second signal.

In an example, the area bounded by each conductive wall with an opening surrounding the film above signal carrying leads of the first signal is an annulus with inner radius substantially equal to but fractionally greater than the diameter of each signal carrying lead.

Orthogonal polarization of antenna patches further improve signal discrimination.

Below the surface layer, another metal wall isolates each quadrature hybrid.

One aspect of the invention is a dual-band phased-array which consists of a planar array of square patch antennas on either ceramic or organic substrate.

For each unit cell, two patches of different sizes are responsible for transmitting and receiving signals at different frequencies. The patches can be microstrip fed, probe (via) fed, or slot-coupled structures.

The unit cell employs stacked-up topology where multiple layers of dielectric materials are used.

One aspect of the invention is an article of manufacture for directed beam electromagnetic (EM) telecommunications.

In an embodiment, each first and second ground plane is separated from its respective antenna patch by a depth of dielectric material proportional to the wavelength of its intended operating frequency in the dielectric material.

CONCLUSION

Thus it can be appreciated that the invention is easily distinguished from conventional phased-array antenna calibration methods. When each phase shifter has 2^k steps (a k-bit phase shifter), the number of possible AWVs would be 2^(k*n). A brute-force calibration going through 2^(k*n) AWVs can take extremely long time.

A number of embodiments of the invention have been described. Nevertheless, it will be understood that various modifications may be made without departing from the spirit and scope of the invention. Accordingly, other embodiments are within the scope of the following claims.

The invention claimed is:

1. A method to calibrate antenna weight vectors for a large phased-array antenna(antenna), the method comprising:

decomposing the antenna into a plurality (L) of receive subarrays, and an identical plurality of transmit subarrays of equal size;

orienting an antenna platform supporting the large array to cause peaking of the array received power from a test horn;

determining for each receive sub-array of the L receive sub-arrays, a receive beam from the codebook of the receiver antenna weight vector (AWV) for the whole array;

and, obtaining a sub-array transmit beam by exhaustively searching through all possible AWVs on the condition that number of all possible transmit sub-array AWVs are reasonable.

2. The method of claim 1 further comprising: obtaining a sub-array transmit beam by applying a hill climbing strategy on a gradient of the received power as a function of the AWV in an optimized search.

3. The method of claim 1 further comprising:

obtaining a sub-array transmit beam by geometric direction relative to the antenna plane of the receive subarray and using mathematically derived AWV for that direction.

4. The method of claim 3 further comprising:

searching a small solid angle around the geometric direction to account for possible hardware implementation imperfection or tolerances.

5. The method of claim 1 wherein all subarray transmit beams are aligned with the subarray receive beams.

6. The method of claim 1 further comprising: for each receive beam of a larger subarray of the entire array, adjusting the antenna platform orientation to peak the array received power from the test horn; and forming a receive/transmit beam of the whole array from the combined corresponding receive/transmit sub-array AWV.

7. The method of claim 6 further comprising:

searching among the AWVs from the calibrated transmit subarray in small perturbed direction around the intended direction to increase the received signal strength of the test horn.

8. The method of claim 6 further comprising:

searching among the AWVs from the calibrated transmit subarray in subset of AWVs around intended direction to increase the received signal strength of the test horn.

* * * * *